United States Patent [19]

Wasicek et al.

[11] Patent Number: 4,763,879

[45] Date of Patent: Aug. 16, 1988

[54] METAL FENCE POST CONNECTOR

[76] Inventors: Michael D. Wasicek, 815 Lake Vermillion Ct., Slidell, La. 70461; Larry D. Wasicek, P.O. Box 309, Round Mountain, Nev. 89045

[21] Appl. No.: 58,580

[22] Filed: Jun. 5, 1987

[51] Int. Cl.[4] ..... B21F 27/00

[52] U.S. Cl. ..... 256/36; 256/70; 256/56

[58] Field of Search ..... 403/191, 192, 374; 256/70, 56, DIG. 5, 36, 54; 248/231.3

[56] References Cited

U.S. PATENT DOCUMENTS

| | | | |
|---|---|---|---|
| 269,845 | 1/1883 | Fox | 256/56 |
| 303,729 | 8/1883 | Hanika | 256/22 |
| 619,684 | 2/1899 | Emerton et al. | 256/35 |
| 1,159,856 | 11/1915 | Michod | 52/150 |
| 1,249,848 | 12/1917 | Sprague | 52/150 |
| 1,252,569 | 1/1918 | Henning | 52/150 |
| 1,330,808 | 2/1920 | James | 52/150 |
| 1,725,475 | 8/1929 | Peterson | 52/150 |
| 2,147,496 | 2/1939 | Nelson | 52/150 |
| 3,670,468 | 6/1972 | Cordell, Sr. | 52/298 |
| 4,078,754 | 3/1978 | Gould | 256/54 X |
| 4,679,772 | 7/1978 | Peterson | 256/36 |

FOREIGN PATENT DOCUMENTS

| | | | |
|---|---|---|---|
| 13835 | of 1891 | United Kingdom | 403/191 |
| 244656 | 12/1925 | United Kingdom | 403/191 |

*Primary Examiner*—Andrew V. Kundrat
*Attorney, Agent, or Firm*—Munson H. Lane, Jr.

[57] ABSTRACT

A metal fence connector is provided for removably mounting braces to a metal T-shaped fence post thereby facilitating the use of metal fence posts where lateral strength is needed. Conventional T-shaped posts are formed with a series of longitudinally disposed knobs or projections which enable the connector of this invention to obtain interlocking attachment with the post by means of an apertured collar that selectively receives a projection as the connector is vertically positioned on the post. A wedge member is utilized to secure the connector to the post in the desired position.

16 Claims, 2 Drawing Sheets

METAL FENCE POST CONNECTOR

BACKGROUND OF THE INVENTION

This invention relates to improvements in metal fence post connectors particularly to that class of connectors adapted to interlock with posts or the like of T-shape cross-section to secure the posts in a relative fixed position by use of brace structure connected to the connector.

Currently, metal fence posts of T-shape cross-section are widely used for the installation of permanent as well as temporary barbed wire fences, electric fences, snow fences and the like. This is largely due to the reduced cost of metal fence posts as well as the ease of installation and, where desired, removal. However, because of the lack of any lateral strength in such metal posts, one solution has been to set wooden posts wherever gates, gaps, corners or changes in direction of the fencing are desired to resist the forces to which the posts are subjected.

As evidenced by the prior art, vertically adjustable connectors of various forms have long been utilized to attach braces and the like to fence posts. Representative of such prior art wherein the posts are of circular cross-section rather than T-shaped are:

| | | |
|---|---|---|
| 269,845 | Fox | Jan. 2, 1883 |
| 303,729 | Hanika | Aug. 19, 1884 |
| 619,684 | Emerton et al | Feb. 14, 1899 |
| 1,249,848 | Sprague | Dec. 11, 1917 |
| 1,330,808 | James | Feb. 17, 1920 |

The prior art further evidences attempts to provide bracing to metal fence posts which have a configuration other than a circular cross-section, e.g.,

| | | |
|---|---|---|
| 1,159,856 | Michod | Nov. 9, 1915 |
| 1,252,569 | Henning | Jan. 8, 1918 |
| 1,725,475 | Peterson | Aug. 20, 1929 |

Various forms of connectors or attachments have also been designed for use with such T-shaped metal posts for interlocking engagement with the projections, but do not incorporate the wedge features, etc., of the subject invention. Representative are such patents as:

| | | |
|---|---|---|
| 2,147,496 | Nelson | Feb. 14, 1939 |
| 4,078,754 | Gould | Mar. 14, 1978 |

Similar connector hardware wherein a sleeve is secured to a T-shaped post by means of a slotted wedge member has been broadly used to anchor the base of a fence post into the ground as in U.S. Pat. No. 3,670,468. However, U.S. Pat. No. 3,670,468 does not disclose the bracing and the interlocking features of this invention.

SUMMARY OF THE INVENTION

The connector of this invention provides a means to attach quickly and inexpensively braces to metal T-shaped fence posts. The connector is of simple construction comprising only two parts, one being a collar encircling the post and having openings cooperating with one of the projections formed along the outer face of the post and the other part being a wedge member to tighten the collar relative to the post. A brace can be simply constructed by attaching the connector at either one or both ends of a piece of pipe, metal angle, piece of lumber or the like. Braces so formed can be used singly or in pairs for interlocking engagement with associated metal posts as corner braces, X-braces, etc., to provide the necessary lateral strength to the metal fence posts.

With the foregoing objects and features in view and such other objects and features as may become apparent as this specification proceeds, the invention will be understood from the following description taken in conjunction with the accompanying drawings wherein like characters of reference are used to designate like parts and wherein:

DETAILED DESCRIPTION

Figure 1:
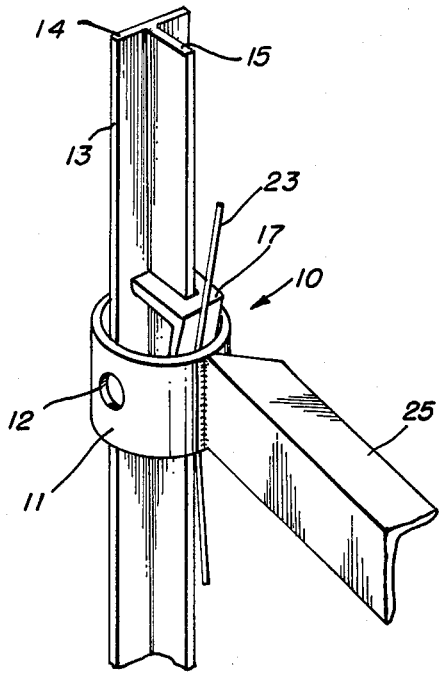
FIG. 1 is a rear fragmentary perspective view showing the connector of the present invention with a metal angle attached to form a connector-brace combination interlocked with a T-shaped fence post.
Figure 2:
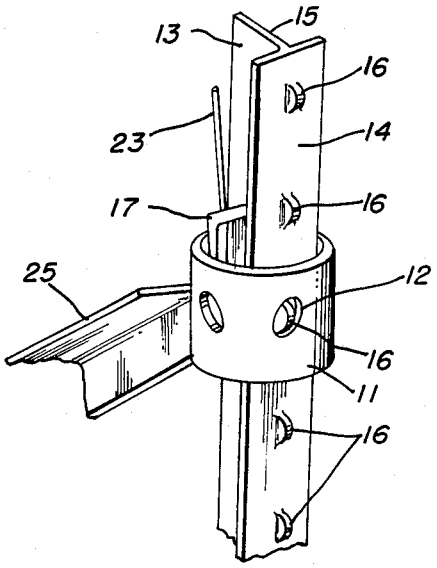
FIG. 2 is a front fragmentary perspective view of the connector-brace combination of FIG. 1 showing the interlocking engagement with the projections formed on the front face of the head of a metal T-shaped fence post.
Figure 3:
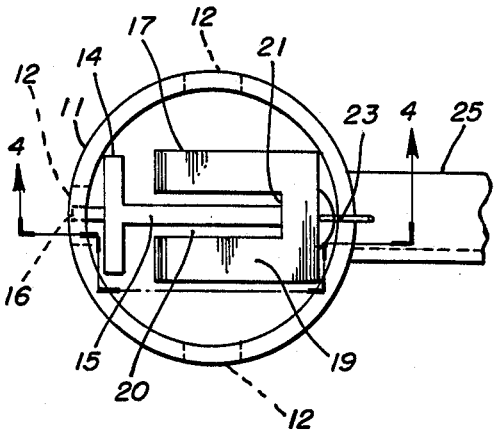
FIG. 3 is a fragmentary top plan view of the connector-brace combination of FIG. 1 with the connector-brace interlocked with a metal T-shaped fence post.
Figure 4:
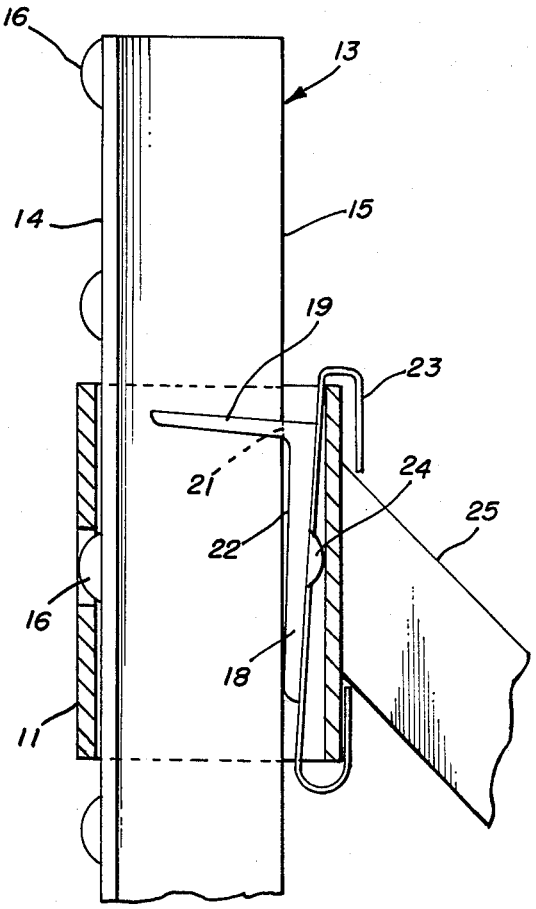
FIG. 4 is a fragmentary view partially in vertical section taken on line 4—4 of FIG. 3 showing the connector-brace combination interlocked with a fence post, the wedge member having been driven into final secure position and with the attaching wire deformed about the collar to secure the wedge.

The connector assembly denoted generally by the reference numeral 10 comprises a collar 11 with three openings 12 positioned circumferentially and equidistantly in a 180° segment to enable multiple positioning of the collar. The diameter of the collar is such as to enable the collar to be slidably positioned along the metal post denoted generally by the reference numeral 13 which is T-shaped in cross-section with a front or head portion 14 and a central leg or web portion 15 extending rearward. Along the front portion 14 are formed knobs or projections 16 which are normally equally spaced along the front face of the post. The openings 12 of the collar are of a size to receive a projection and thereby selectively position the collar upon the post.

Figure 5:
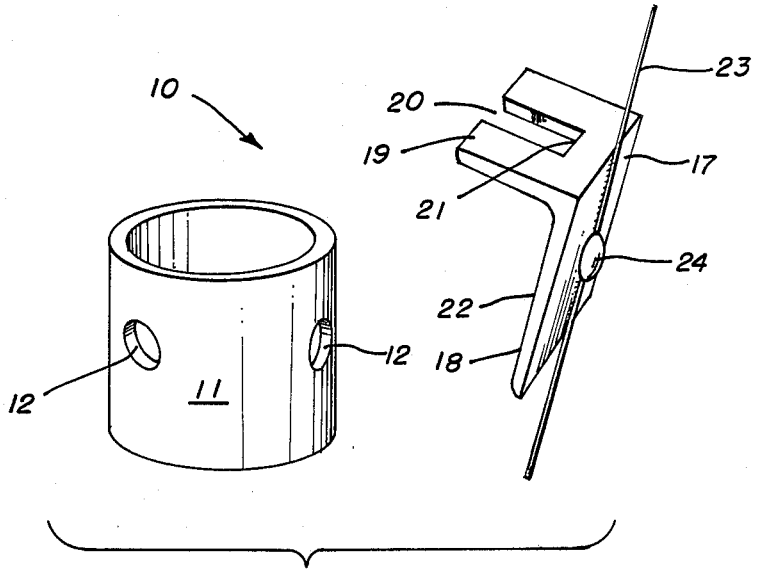
FIG. 5 is an exploded perspective view of the connector collar and associated wedge and attaching wire.

The connector further comprises a wedge member denoted generally by the reference numeral 17 (FIG. 5) of L-shape configuration including a depending leg 18 having a slightly tapered cross-section and a transverse leg 19 formed with a notch 20. In use, the wedge member is positioned so that the notch receives the central web portion of the post with the depending leg adapted to be forced down inside the collar against the rear face of the central web opposite the head. The wedging action is obtained by forming the notch of a depth such that the base 21 of the notch is spaced from the plane defined generally by the inner face 22 of the depending leg 18 of the wedge member whereby upon positioning the wedge member against the rear face of the central web portion, the wedge member is cocked relative to the longitudinal axis of the post.

The connector further comprises a deformable wire member 23 suitably secured at 24 to the outer face of the depending leg member 18 of the wedge. The wire member 23 functions to secure the wedge to the collar in its final position and also to prevent separation when handled as a unit for sale, etc.

The manner of securing the connector to the post is believed clear from the above description. The collar is simply slidably moved on the post to the vertical position desired wherein a post projection is received by a collar opening. The wedge member is positioned with the notch receiving the central web and the depending leg bearing against the rear face of the web and the inner wedge of the collar. The wedge member may be driven into a final secured position wherein the collar is forced against the post and interlocked therewith. The ends of the wire may be deformed about the collar to secure the wedge member in position.

A brace for use in fence installations is very simply constructed by attaching a connector at either or both ends of a piece of metal, lumber or the like. As shown in FIGS. 1–4 of the drawings, a metal angle 25 forms the brace and has been secured to the exterior of the collar diametrically opposite to the central one of the openings 12.

Figure 6:
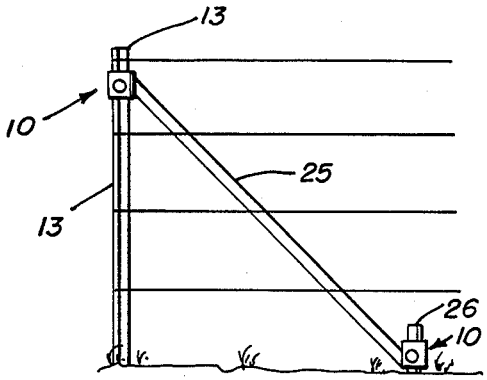
FIGS. 6 and 7 are elevational views of fence post installations wherein the connector of this invention is used in a cross-bracing for a gate post (FIG. 7) and in end post bracing (FIG. 6).
Figure 7:
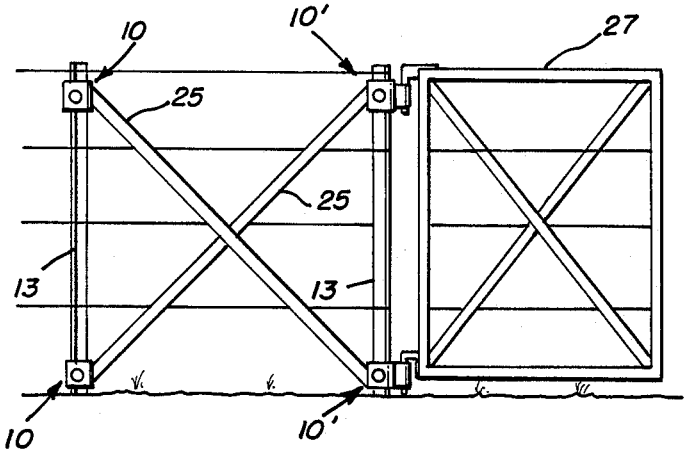
Figure 8:
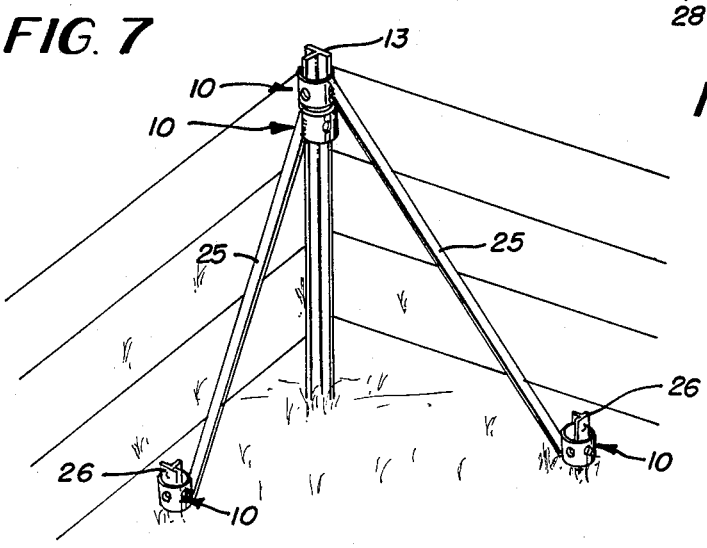
FIG. 8 is a perspective view of a fence post installation wherein the connector is used in a bracing arrangement for a corner post.

By suitably securing a connector at both ends of a metal piece, such as angle iron 25, a number of bracing arrangements are quickly and inexpensively obtained in fencing installations as shown in FIGS. 6–8.

Figure 9:
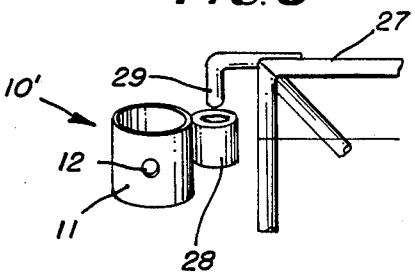
FIG. 9 is a perspective view of the connector embodiment of FIG. 7 which incorporates an attached pintle housing for pivotally mounting the associated gate.

In FIG. 7, two connector-brace structures are used as an X-bracing. A connector is shown at both ends of two brace members which are arranged in the form of an X. According to this arrangement, a second T-shaped post is positioned adjacent a T-shaped post desired to be used for supporting a gate 27. A pivotal mounting for the gate is provided by pintles 29 received in respective cylindrical housings 28 (FIG. 9) secured to each connector collar 11 of connector 10'.

In FIG. 8, two connector-brace structures are used to provide the necessary lateral support for a corner T-shaped post in a fence installation. The brace structures are mounted on the post in the manner heretofore described with the connectors adjacent each other and on the same end of the post with the brace structures angularly disposed in the direction of the fencing structure as shown and with the opposite ends interlocked in similar manner to short ground anchor posts 26.

While in the foregoing there has been shown and described a preferred embodiment of the invention, various modifications may become apparent to those skilled in the art to which the invention relates. Accordingly it is not desired to limit the invention to this disclosure, and various modifications and equivalents may be resorted to, falling within the spirit and scope of the invention as claimed.

What is claimed is:

1. A connector for attaching bracing to a metal post having spaced projections extending along one face thereof, said connector comprising a collar of a dimension to be movable along said post over said projections, said collar having at least one opening of a size adapted to receive one projection in a selected positioning of the collar and a wedge member adapted to be positioned between the post and an interior surface of the collar responsive to a driving force to effect an interlocking engagement of the collar and post, said wedge member including a deformable wire-like means for engaging the collar to secure the wedge member against relative movement.

2. The combination of a metal fence post and a brace therefor, the said fence post comprising a post of T-shaped cross-section with longitudinally extending head and central web structures and projections extending axially along the outer face of the head structure, the said brace having a connector for attaching said brace to the post comprising a collar of a dimension to be movable along said post over said projections, said collar having at least one opening of a size to receive one projection in a selected positioning of the collar and a wedge member positioned between the post and an interior surface of the collar responsive to a driving force to effect an interlocking engagement of the collar and post, said wedge being provided with a notch to slidably receive the web structure for guiding the wedge in its movement.

3. The combination as set forth in claim 2 wherein the depth of the notch is so defined as to provide for a cocking of the wedge member relative to the post axis upon positioning same upon the post.

4. The combination as set forth in claim 2 wherein the collar is provided with at least three circumferentially disposed openings of a size to receive selectively one of said projections for fixedly positioning the collar upon the post.

5. A fence post installation having bracing means for providing lateral post support comprising a metal fence post of T-shaped cross section with longitudinally extending head and central web structures and projections extending axially along the outer face of the head structure, a connector for attaching said bracing means to said post comprising a collar of a dimension to be movable along said post over said projections, said collar having at least one opening of a size to receive one projection in a selected positioning of the collar and a wedge member positioned between the post and an interior surface of the collar responsive to a driving force to effect an interlocking engagement of the collar and post, said wedge being provided with a notch to slidably receive the web structure for guiding the wedge in its movement, and said bracing means including a brace member attached to the collar and anchor means provided at the opposite end of the brace member to provide said post support.

6. A fence post installation as set forth in claim 5 wherein the anchor means comprises a second connector similar to the first recited connector attached to the opposite end of the brace member for securing same to a ground anchor post.

7. A fence post installation having bracing means for providing lateral post support comprising a metal fence post having spaced projections extending along one face thereof, a connector for attaching said bracing means to said post comprising a collar of a dimension to be movable along said post over said projections, said collar having at least one opening of a size to receive one projection in a selected positioning of the collar and a wedge member positioned between the post and an interior surface of the collar responsive to a driving force to effect an interlocking engagement of the collar and post, and said bracing means including a brace member attached to the collar and anchor means provided at the opposite end of the brace member to provide said post support, and a second connector mounted at the opposite end of the post, said second connector including a collar having a brace member attached thereto and similarly anchored at its opposite end, the anchor means comprising an adjacent post to which both brace members are attached.

8. A fence post installation as set forth in claim 7 wherein the brace members extend in directions as to form cross-bracing.

9. A fence post installation wherein the fence post is to serve as a corner post having bracing means for providing lateral post support comprising a metal fence post having spaced projections extending along one face thereof a connector for attaching said bracing means to said post comprising a collar of a dimension to be movable along said post over said projections, said collar having at least one opening of a size to receive one projection in a selected positioning of the collar and a wedge member positioned between the post and an interior surface of the collar responsive to a driving force to effect an interlocking engagement of the collar and post, and said bracing means including a brace member attached to the collar and anchor means provided at the opposite end of the brace member to provide said post support, and a second connector mounted adjacent the first connector on the same end of the post, said second connector including a collar having a brace member attached thereto and similarly anchored at its opposite end with the brace members disposed at an angle relative to the longitudinal axis of the post.

10. A connector for attaching bracing to a metal post having spaced projections extending along one face thereof, said connector comprising a collar of a dimension to be movable along said post over said projections, said collar having at least one opening of a size adapted to receive one projection in a selected positioning of the collar and a wedge member adapted to be positioned between the post and an interior surface of the collar responsive to a driving force to effect an interlocking engagement of the collar and post, said collar having a cylindrical housing member secured longitudinally and exteriorly thereof for receiving the hinge pintle of a gate.

11. A connector for adjustable attachment at selected positions along the length of a metal post of T-shaped cross section having a longitudinally extending head and central web structures and longitudinally spaced projections along the outer face of the head structure, said connector comprising a collar of a dimension to be movable along said post over said projections, said collar having at least one opening of a size adapted to receive one projection in a selected positioning of the collar and a wedge member adapted to be positioned between the post and an interior surface of the collar responsive to a driving force to effect an interlocking engagement of the collar and post, said wedge member being of L-shaped configuration having a transverse leg and a depending leg, said transverse leg having a notch therein to slidable receive the web structure of said post for guiding the wedge in its movement.

12. The connector of claim 11 wherein said depending leg of said wedge is tapered downwardly from said transverse leg.

13. A connector as set forth in claim 12 wherein said notch in said transverse leg of said wedge is of a depth such that the base of the notch is spaced from a plane defined generally by the inner face of said depending leg whereby upon positioning said wedge against the rear face of said central web structure, the wedge is cocked relative to the longitudinal axis of said post.

14. A connector as set forth in claim 11 wherein said collar has a cylindrical housing member secured longitudinally and exteriorly thereof for receiving the hinge pintle of a gate.

15. A connector as set forth in claim 11 wherein the collar is of annular configuration with the internal diameter of a dimension to provide for free longitudinal movement of the collar.

16. A connector as set forth in claim 11 wherein the collar is provided with at least three circumferentially disposed openings of a size to receive selectively one of said projections for fixedly positioning the collar upon the post.

* * * * *